US009465326B1

(12) United States Patent
Maruyama et al.

(10) Patent No.: US 9,465,326 B1
(45) Date of Patent: Oct. 11, 2016

(54) IMAGE FORMING APPARATUS HAVING A CONTROLLER FOR CONTROLLING TONER DISCHARGE OPERATION

(71) Applicant: FUJI XEROX CO., LTD., Tokyo (JP)

(72) Inventors: Akihisa Maruyama, Ebina (JP); Toshie Nakamoto, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/874,936

(22) Filed: Oct. 5, 2015

(30) Foreign Application Priority Data

Jun. 26, 2015 (JP) ..... 2015-128716

(51) Int. Cl.
*G03G 15/00* (2006.01)
*G03G 15/16* (2006.01)

(52) U.S. Cl.
CPC ..... *G03G 15/161* (2013.01)

(58) Field of Classification Search
CPC ..... G03G 15/161
USPC ..... 399/66, 301, 302, 49
See application file for complete search history.

(56) References Cited

U.S. PATENT DOCUMENTS 6,434,348 B1 * 8/2002 Tomizawa ..... G03G 15/1675 399/49
7,444,090 B2 * 10/2008 Nishida ..... G03G 15/0131 399/49
2010/0111556 A1 * 5/2010 Shibuya ..... G03G 15/0275 399/71
2011/0110676 A1 * 5/2011 Higa ..... G03G 15/1675 399/49

FOREIGN PATENT DOCUMENTS

JP 2009063669 A 3/2009
JP 2013-109342 A 6/2013

* cited by examiner

*Primary Examiner* — Quana M Grainger
(74) *Attorney, Agent, or Firm* — Oliff PLC

(57) ABSTRACT

An image forming apparatus includes an intermediate transfer body, an image forming device including an image carrier (carrier), a developing device that develops an electrostatic latent image on the carrier into a toner image with a two-component developer (toner and carrier), a first transfer device that transfers the toner image onto the intermediate transfer body, and a first cleaning device that cleans the carrier's surface after the transfer process, a second transfer device that transfers the toner image onto a recording medium, a second cleaning device that cleans the intermediate transfer body's surface after the transfer process, a power-supplying device that supplies a developing bias, a first transfer bias, and a second transfer bias to the developing device, the first transfer device, and the second transfer device, respectively, and a controller that controls to perform a toner discharging operation of forming a toner image to be discharged on the carrier.

2 Claims, 8 Drawing Sheets

FIG. 5

<NORMAL IMAGE FORMING OPERATION>

| | DEVELOPING POSITION (DEVELOPING BIAS DB) | FIRST TRANSFER POSITION (FIRST TRANSFER BIAS TB) | SECOND TRANSFER POSITION (SECOND TRANSFER BIAS NB) |
|---|---|---|---|
| POLARITY OF BIAS TO BE SUPPLIED | − | + | − |
| POLARITY OF CHARGE INJECTED CARRIER WHEN PASSING THROUGH EACH POSITION | − | + | − |
| TRANSFER DESTINATION OF CHARGE INJECTED CARRIER | PHOTOCONDUCTOR DRUM | PHOTOCONDUCTOR DRUM | (RECORDING SHEET) |

<TONER DISCHARGING OPERATION OF RELATED ART>

| | DEVELOPING POSITION (DEVELOPING BIAS DB) | FIRST TRANSFER POSITION (FIRST TRANSFER BIAS TB) | SECOND TRANSFER POSITION (SECOND TRANSFER BIAS NB) |
|---|---|---|---|
| POLARITY OF BIAS TO BE SUPPLIED | − | 0 | + |
| POLARITY OF CHARGE INJECTED CARRIER WHEN PASSING THROUGH EACH POSITION | − | − | + |
| TRANSFER DESTINATION OF CHARGE INJECTED CARRIER | PHOTOCONDUCTOR DRUM | INTERMEDIATE TRANSFER BELT | SECOND TRANSFER ROLLER |

FIG. 6

| | DEVELOPING POSITION (DEVELOPING BIAS DB) | FIRST TRANSFER POSITION (FIRST TRANSFER BIAS TB) | SECOND TRANSFER POSITION (SECOND TRANSFER BIAS NB) |
|---|---|---|---|
| POLARITY OF BIAS TO BE SUPPLIED | − | + | + |
| POLARITY OF CHARGE INJECTED CARRIER WHEN PASSING THROUGH EACH POSITION | − | + | + |
| TRANSFER DESTINATION OF CHARGE INJECTED CARRIER | PHOTOCONDUCTOR DRUM | PHOTOCONDUCTOR DRUM | (SECOND TRANSFER ROLLER) |

FIG. 7

| TONER BAND | | DEPOSITION STATE OF CARRIER ON INTERMEDIATE TRANSFER BELT |
|---|---|---|
| WIDTH w (mm) | DENSITY (%) | |
| 0 | — | A |
| 50 | 100 | A |
| 70 | 100 | B |
| 200 | 100 | C |
| 200 | 60 | D |

FIG. 8

| No. | WIDTH w (mm) OF TONER BAND | CONTROL PERCENTAGE OF FIRST TRANSFER BIAS (%) | DEPOSITION STATE OF CARRIER ON INTERMEDIATE TRANSFER BELT | RESIDUAL STATE (RESIDUAL PERCENTAGE) OF TONER ON PHOTOCONDUCTOR DRUM |
|---|---|---|---|---|
| 1 | 200 | 100 | A | C (1%) |
| 2 | 200 | 80 | A | C (2%) |
| 3 | 200 | 70 | A | B (4%) |
| 4 | 200 | 50 | A | A (13%) |
| 5 | 200 | 40 | A | A (20%) |
| 6 | 200 | 30 | B | A (30%) |
| 7 | 200 | 20 | C | A (40%) |
| 8 | 200 | 0 (OFF) | D | A (50%) |

IMAGE FORMING APPARATUS HAVING A CONTROLLER FOR CONTROLLING TONER DISCHARGE OPERATION

CROSS-REFERENCE TO RELATED APPLICATIONS

This application is based on and claims priority under 35 USC 119 from Japanese Patent Application No. 2015-128716 filed Jun. 26, 2015.

BACKGROUND

Technical Field

The present invention relates to an image forming apparatus.

SUMMARY

According to an aspect of the invention, there is provided an image forming apparatus including an intermediate transfer body, an image forming device that includes an image carrier on which an electrostatic latent image is to be formed, a developing device that develops the electrostatic latent image on the image carrier into a toner image with a two-component developer containing a toner and a carrier, a first transfer device that transfers in a first transfer process the toner image on the image carrier onto the intermediate transfer body, and a first cleaning device that comes into contact with a surface of the image carrier and cleans the surface of the image carrier after the toner image has been transferred to the intermediate transfer body, a second transfer device that transfers in a second transfer process the toner image, which has been transferred from the image forming device to the intermediate transfer body, onto a recording medium, a second cleaning device that comes into contact with a surface of the intermediate transfer body and cleans the surface of the intermediate transfer body after the toner image has been transferred to the recording medium, a power-supplying device that supplies a developing bias, a first transfer bias, and a second transfer bias to the developing device, the first transfer device, and the second transfer device, respectively, and a controller that performs control in such a manner that a toner discharging operation, in which a toner image that is to be discharged and that is not to be transferred onto the recording medium is formed on the image carrier, is performed in the image forming device. When the toner discharging operation is performed, the controller performs control in such a manner that a direct current or a direct-current voltage having a value not smaller than a value of a current or a voltage that enables an electric charge to be injected into the carrier that is present in the toner image, which is to be discharged, is supplied as the first transfer bias, which is supplied from the power-supplying device.

BRIEF DESCRIPTION OF THE DRAWINGS

Exemplary embodiments of the present invention will be described in detail based on the following figures, wherein:

FIG. 5 is a table showing conditions for each bias and a carrier and transition states of the carrier in a normal image forming operation and conditions for each bias and a carrier and transition states of the carrier in a toner discharging operation of the related art;

FIG. 6 is a table showing conditions for each bias and a carrier and transition states of the carrier in the toner discharging operation according to the exemplary embodiment of the present invention;

FIG. 7 is a table showing results of Test 1; and

FIG. 8 is a table showing results of Test 2.

DETAILED DESCRIPTION

An exemplary embodiment of the present invention will be described below with reference to the accompanying drawings.

Exemplary Embodiment

Figure 1:
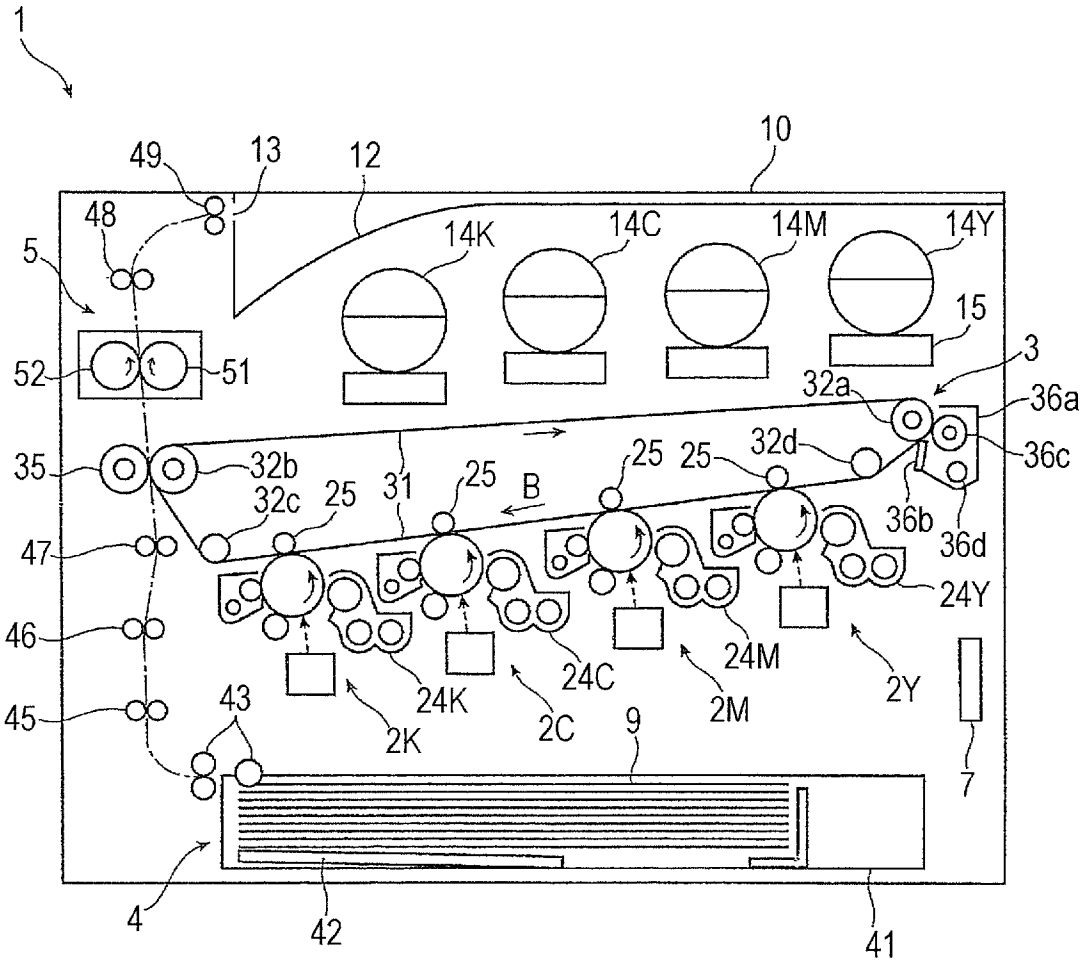
FIG. 1 is an overall view conceptually illustrating an image forming apparatus according to an exemplary embodiment.
Figure 2:
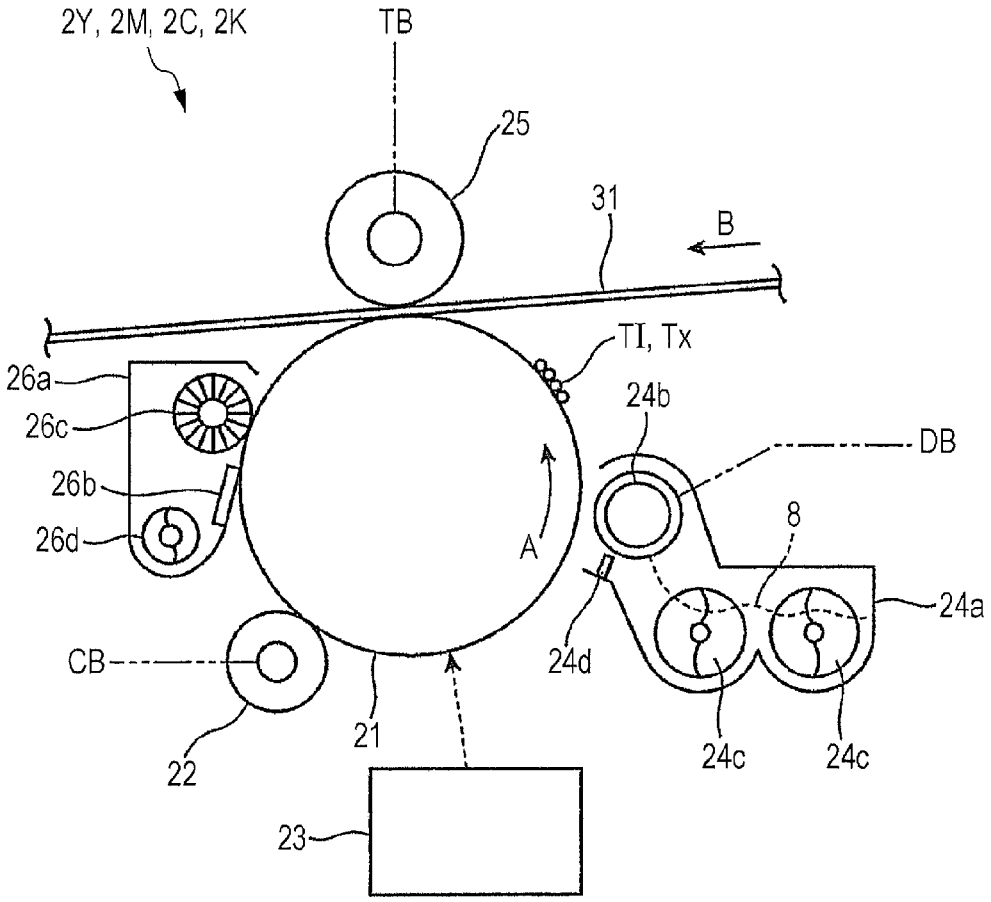
FIG. 2 is a diagram conceptually illustrating a portion (such as image forming device) of the image forming apparatus illustrated in FIG. 1.

FIG. 1 and FIG. 2 illustrate an image forming apparatus according to an exemplary embodiment. FIG. 1 illustrates an overview of the image forming apparatus, and FIG. 2 illustrates a portion (image forming device) of the image forming apparatus.

<Overall Configuration of Image Forming Apparatus>

An image forming apparatus 1 according to the exemplary embodiment forms an image, which is made of a developer, on one of recording sheets 9, each of which is an example of a recording medium, and is configured to serve as, for example, a printer that performs image formation as a result of receiving image information input from an external device, such as an information terminal device. Note that, in the case where the image forming apparatus 1 is provided with, for example, a document reading device, the image forming apparatus 1 may serve as a copying machine or may serve as a copying machine that has a fax function.

The image forming apparatus 1 includes a housing 10 whose overall appearance has the shape of a box. In an internal space of the housing 10, image forming devices 2, an intermediate transfer device 3, a sheet feed device 4, a fixing device 3, and the like are disposed. Each of the image forming devices 2 forms a toner image made of a toner, which serves as a developer. The intermediate transfer device 3 holds toner images, which have been formed by the image forming devices 2 and transferred in a first transfer process to the intermediate transfer device 3, and then transports the toner images to a second transfer position at which the toner images are eventually transferred in a second transfer process onto one of the recording sheets 9. The sheet feed device 4 accommodates and sends out the recording sheets 9, each of which is to be fed to the second transfer position of the intermediate transfer device 3. The fixing device 5 fixes the toner images, which have been transferred in the second transfer process to one of the recording sheets 9 by the intermediate transfer device 3, onto the recording sheet 9. The housing 10 includes a support structural portion and an exterior portion that are formed of a support member, an exterior cover, and the like. An ejection-and-accommodation unit 12 which the recording sheet 9, on which an image has been formed, is to be ejected to and accommodated in is formed in a top surface portion of the housing 10. A one dot chain line illustrated in FIG. 1 indicates a sheet transport path along which the recording sheets 9 are to be transported in the housing 10.

The image forming devices 2 include four image forming devices 2Y, 2M, 2C, and 2K that respectively form developer (toner) images of four colors of yellow (Y), magenta (M), cyan (C), and black (K).

As illustrated in FIG. 1 and FIG. 2, the four image forming devices 2 (Y, M, C, and K) include photoconductor drums 21, charging devices 22, exposure devices 23, developing devices 24 (Y, M, C, and K), first transfer devices 25, and drum-cleaning devices 26. The photoconductor drums 21 are driven so as to rotate. The charging devices 22 charge image-holding surfaces, each of which is a portion of the outer circumferential surface of one of the photoconductor drums 21, so as to have a predetermined potential. The exposure devices 23 radiate, on the basis of image information, light beams (dashed arrows illustrated in FIG. 1) decomposed into different color components (Y, M, C, and K) onto the image-holding surfaces of the corresponding photoconductor drums 21, which have been charged, and form electrostatic latent images each having the corresponding color component. The developing devices 24 (Y, M, C, and K) develop the electrostatic latent images into visible toner images of the corresponding colors (Y, M, C, and K) by supplying toners having the corresponding color components. The first transfer devices 25 transfer the toner images formed on the photoconductor drums 21 onto the intermediate transfer device 3 (intermediate transfer belt 31 of the intermediate transfer device 3) in a first transfer process. The drum-cleaning devices 26 clean the outer circumferential surfaces of the photoconductor drums 21 by removing unwanted substances, such as toner that remains on the outer circumferential surfaces of the photoconductor drums 21.

As each of the photoconductor drums 21, for example, a drum-shaped photoconductor that is formed of a cylindrical or columnar base member, which is grounded and which has, as a portion of its circumferential surface, an image-holding surface that has a photoconductive layer (photosensitive layer) made of a photosensitive material, is employed. Each of the photoconductor drums 21 is arranged in such a manner as to be driven and rotated in the direction of arrow A as a result of receiving a force from a rotational driving device (not illustrated).

As each of the charging devices 22, for example, a contact charging device that is disposed in a state of being in contact with at least the image-holding surface of the corresponding photoconductor drum 21 and that includes a contact member, such as a charging roller, that is supplied with a charge bias CB is employed. Alternatively, a non-contact charging device, such as a corona discharger, may be employed as each of the charging devices 22. In the case where each of the developing devices 24 performs reversal development, a direct or alternating current or a direct-current (DC) or alternating-current (AC) voltage having a polarity the same as the charge polarity of the toners supplied by the developing devices 24 is supplied as the charge bias CB by a power-supply device 6, which will be described later.

As each of the exposure devices 23, for example, a non-scanning exposure device that includes a light-emitting diode, an optical component, and the like is employed. Alternatively, for example, a scanning exposure device that includes a semiconductor laser and an optical component, such as a polygon mirror, may be employed as each of the exposure devices 23. Image information that is input from the outside is subjected to predetermined processing performed by an image processing apparatus (not illustrated) and then input to each of the exposure devices 23 as an image signal.

As illustrated in FIG. 2 and the like, each of the developing devices 24 (Y, M, C, and K) includes a housing 24*a* that has a containing chamber and an opening used for a developing operation. The containing chamber contains a two-component developer 8, which contains a non-magnetic toner T having a corresponding one of the color components (Y, M, C, and K) and a magnetic carrier. In addition, each of the developing devices 24 (Y, M, C, and K) includes a developing roller 24*b*, transport members 24*c*, such as screw augers, and a layer-thickness control member 24*d*. The developing roller 24*b* holds the corresponding two-component developer 8, which is contained in the corresponding housing 24*a*, while rotating and that transports the two-component developer 8 in such a manner that the two-component developer 8 passes through a development region, which is formed in the vicinity of the corresponding photoconductor drum 21 so as to face the photoconductor drum 21 in the corresponding opening used for a developing operation. Each of the transport members 24*c* transports the two-component developer 8, which is contained in the containing chamber of the housing 24*a*, in such a manner that the two-component developer 8 is supplied to the developing roller 24*b* while stirring the two-component developer 8 by rotating. The layer-thickness control member 24*d* controls the amount (layer thickness) of the two-component developer 8 held by the developing roller 24*b*.

In each of the developing devices 24 (Y, M, C, and K), the developing roller 24*b* and the transport members 24*c* are made to rotate in a predetermined direction as a result of receiving a force from the rotational driving device (not illustrated). The developing roller 24*b* is supplied with a developing bias DB from the power-supply device 6, which will be described later. As the developing bias DB, for example, a voltage obtained by superposing an AC voltage on a DC voltage is supplied. In each of the developing devices 24, the toner T of the two-component developer 8 is transported while being stirred by the transport members 24*c* in the housing 24*a*, so that the toner T is rubbed against the carrier, and consequently, the toner T is frictionally charged so as to have a predetermined polarity (negative polarity in the exemplary embodiment).

As illustrated in FIG. 1, developer cartridges 14 (Y, M, C, and K), which are removable and replaceable and each of which contains a replenishing developer (only containing a toner or containing a toner and a carrier), are each configured to replenish a corresponding one of the developing devices 24 (Y, M, C, and K) with a necessary amount of the replenishing developer via a supply device (not illustrated).

As the carrier of each of the two-component developers 8, a magnetic metal, such as iron oxide, nickel, or cobalt, a magnetic oxide, such as ferrite or magnetite, a resin-coated carrier, which is formed by forming a resin coating layer on a surface of a core made of a magnetic metal or a magnetic oxide, a magnetic dispersion carrier, or the like is used.

As each of the first transfer devices 25, for example, a contact transfer device including a contact member such as a first transfer roller that rotates while being in contact with the surface of the corresponding photoconductor drum 21 and that is supplied with a first transfer bias TB, is employed. As the first transfer bias TB, a direct current or a DC voltage having a polarity opposite to the charge polarity of the toners T is supplied from the power-supply device 6, which will be described later. The first transfer devices 25 may be treated as members that form part of the intermediate transfer device 3.

Each of the drum-cleaning devices 26 includes a housing 26*a*, a plate-shaped member 26*b* and a rotary brush 26*c*, and a delivery member 26*d*, such as a screw auger. The housing 26*a* has an opening used for a cleaning operation. The plate-shaped member 26*b* and the rotary brush 26*c* each comes into contact with at least the image-holding surface of the corresponding photoconductor drum 21, which has passed through a corresponding one of first transfer positions, through the opening used for a cleaning operation so as to remove unwanted substances, such as residual toner. The delivery member 26*d* collects removed substances, such as removed toner, and sends out the removed substances toward a collecting container (not illustrated).

The intermediate transfer device 3 includes the intermediate transfer belt 31, plural support rollers 32*a* to 32*d*, a second transfer roller 35, and a belt-cleaning device 36. The intermediate transfer belt 31 rotates in the direction of arrow B while passing through the first transfer positions between the photoconductor drums 21 of the image forming devices 2 (Y, M, C, and K) and the first transfer devices 25 (first transfer rollers). The plural support rollers 32*a* to 32*d* maintain the intermediate transfer belt 31 in a desired state and rotatably support the intermediate transfer belt 31 from a space enclosed by the inner peripheral surface of the intermediate transfer belt 31. The second transfer roller 35 rotates while being in contact with, at a predetermined pressure, the outer peripheral surface of a portion of the intermediate transfer belt 31 that is supported by the support roller 32*b*. The belt-cleaning device 36 removes unwanted substances, such as residual toner and paper dust deposited on the outer peripheral surface of a portion of the intermediate transfer belt 31 that has passed through the second transfer roller 35.

As the intermediate transfer belt 31, for example, an endless belt that is made of a material, which is obtained by dispersing a resistance-adjusting agent, such as carbon, in a base material, such as a polyimide resin or a polyamide resin, in such a manner as to have a predetermined thickness and a predetermined electrical resistance is employed. Regarding the plural support rollers 32*a* to 32*d*, for example, the support roller 32*a* is configured to serve as a driving roller that supplies a driving force that causes the intermediate transfer belt 31 to rotate to the intermediate transfer belt 31 and a tension-applying roller that exerts a tension on the intermediate transfer belt 31, the support roller 32*b* is configured to serve as a backup roller used in a second transfer process, and the support rollers 32*c* and 32*d* are configured to serve as surface-pressing rollers that form a first-transfer surface of the intermediate transfer belt 31. A second transfer device includes the second transfer roller 35 and the support roller 32*b*. The second transfer roller 35 or the support roller 32*b* of the second transfer device is supplied with a second transfer bias NB from the power-supply device 6, which will be described later. In the case where the second transfer bias NB is supplied to the second transfer roller 35, a direct current or a DC voltage having a polarity opposite to the charge polarity of the toners T is supplied as the second transfer bias NB, and in the case where the second transfer bias NB is supplied to the support roller 32*b*, a direct current or a DC voltage having a polarity the same as the charge polarity of the toners T is supplied as the second transfer bias NB.

The belt-cleaning device 36 includes a housing 36*a*, a plate-shaped member 36*b* and a rotary brush 36*c*, and a delivery member 36*d*, such as a screw auger. The housing 36*a* has an opening used for a cleaning operation. The plate-shaped member 36*b* and the rotary brush 36*c* each comes into contact with at least an image-holding surface of the intermediate transfer belt 31, which has passed through the second transfer position, through the opening used for a cleaning operation so as to remove unwanted substances, such as residual toner. The delivery member 36*d* collects removed substances, such as removed toner, and sends out the removed substances toward a collecting container (not illustrated).

The sheet feed device 4 includes an accommodating unit 41 and a delivery unit 43. The accommodating unit 41 is mounted in such a manner as to be capable of being drawn out of the housing 10 and in which desired types of recording sheets 9 having desired sizes and the like are accommodated in such a manner as to be stacked on top of one another on a stacking plate 42. The delivery unit 43 sends out the recording sheets 9 one by one toward the sheet transport path from the accommodating unit 41. The sheet feed device 4 is not limited to including a single accommodating unit 41 and may include plural accommodating units 41.

The fixing device 5 includes a rotating body 51 for heating in the form of a roller, a belt, or the like that is driven so as to rotate in a predetermined direction and that is to be heated by a heating unit so that the surface temperature thereof is maintained at a predetermined temperature and a rotating body 52 for applying pressure in the form of a roller, a belt, or the like that is driven by the rotating body 51 for heating so as to rotate by being in contact with the rotating body 51 for heating at a predetermined pressure in a direction approximately parallel to a direction in which a rotation axis of the rotating body 51 for heating extends, the rotating body 51 for heating and the rotating body 52 for applying pressure being disposed within a housing of the fixing device 5. In the fixing device 5, a region in which the rotating body 51 for heating and the rotating body 52 for applying pressure are in contact with each other functions as a fixing-treatment part into which one of the recording sheets 9 that holds a toner image is to be introduced and at which the recording sheets 9 is to be subjected to fixing treatments (heating and applying pressure).

As illustrated in FIG. 1, in the housing 10, the sheet transport path, along which the recording sheets 9 are to be transported, is disposed so as to extend from the delivery unit 43 of the sheet feed device 4 to an ejection port 13, which is formed at a position between the fixing-treatment part and the ejection-and-accommodation unit 12, through the second transfer position of the intermediate transfer device 3 and the fixing-treatment part of the fixing device 5. The sheet transport path is formed of plural pairs of transport rollers 45, 46, 47, 48, and 49, a transport-guide member (not illustrated), and the like. In particular, the pair of transport rollers 47 are configured to serve as a pair of registration rollers that has functions of adjusting the timing at which one of the recording sheets 9 is transported to the second transfer position, adjusting the position of the recording sheet 9 when the recording sheet 9 is transported, and the like. The pair of transport rollers 49 are configured to serve as ejection rollers that eject the recording sheets 9 in such a manner as to send out the recording sheets 9 to the ejection-and-accommodation unit 12.

Figure 3:
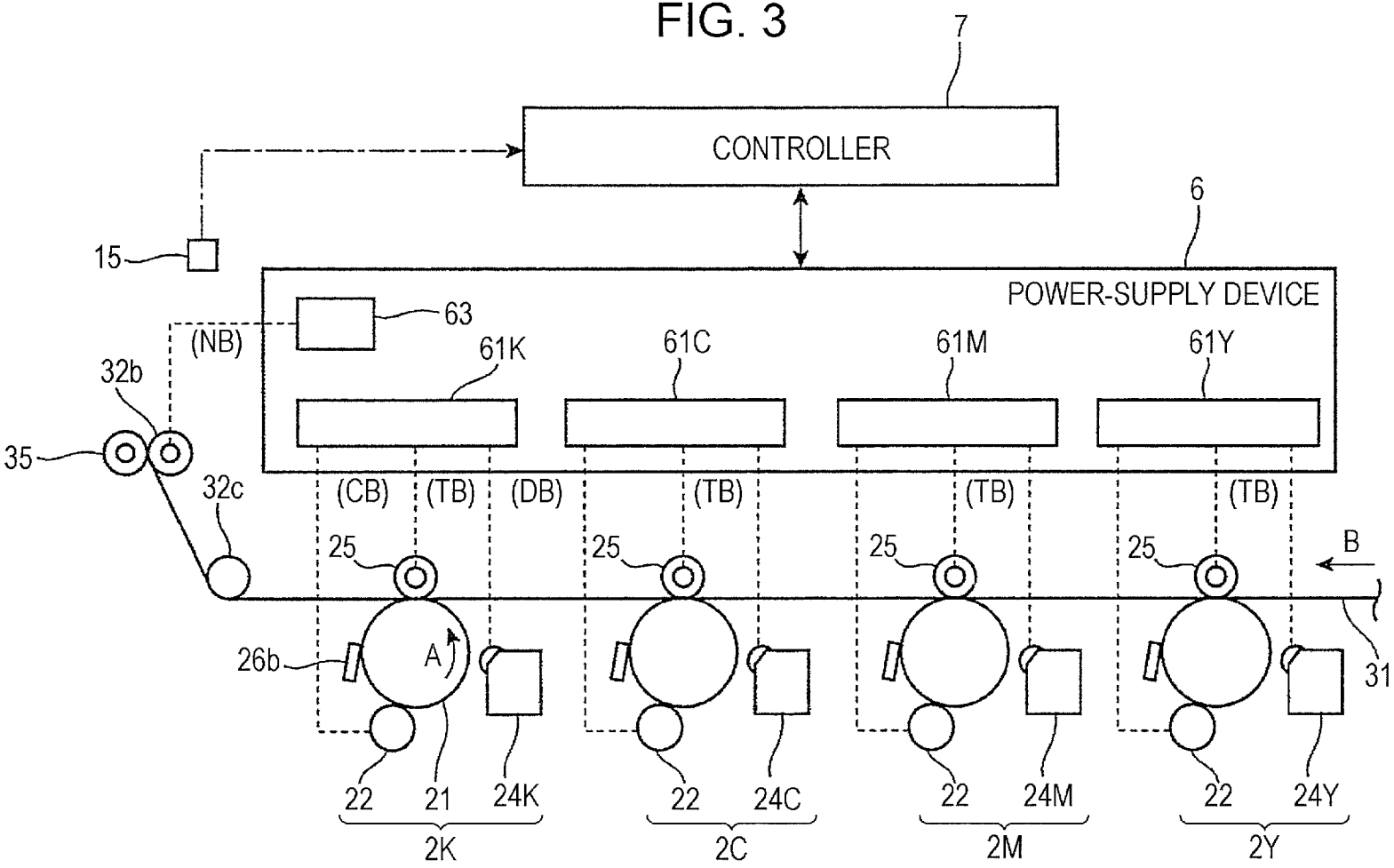
FIG. 3 is a diagram conceptually illustrating the configuration of a power-supply device of the image forming apparatus illustrated in FIG. 1.

As illustrated in FIG. 3, the image forming apparatus 1 includes the power-supply device 6 that supplies at least the charge bias CB, the developing bias DB, the first transfer bias TB, the second transfer bias NB, and the like, which have been mentioned above.

The power-supply device 6 is supplied with electrical power, which is distributed by, for example, power supply (not illustrated), and the power-supply device 6 includes power-supplying units 61 (Y, M, C, and K) that correspond to the four image forming devices 2 (Y, M, C, and K) and a power-supplying unit 63 that corresponds to the second transfer roller 35. The electrical power supplied to the power-supply device 6 is further distributed to and used by the power-supplying units 61 and the power-supplying unit 63. The power-supplying units 61 (Y, M, C, and K) are electrically connected to the charging devices 22 (charging rollers), the developing devices 24 (developing rollers 24*b*), and the first transfer devices 25 (first transfer rollers) of the corresponding image forming devices 2 (Y, M, C, and K) and generate currents or voltages forming the biases (CB, DB, and TB) necessary for the devices, which are to be supplied with the electrical power, so as to supply the currents or the voltages to the devices. The power-supplying unit 63 is electrically connected to the second transfer roller 35 and generates the bias NB necessary for the second transfer roller 35 so as to supply the bias NB to the second transfer roller 35.

A control unit 7, which will be described later, controls, for example, a power-supplying operation (including an ON/OFF operation of the power supply and an operation of setting conditions, such as the values of a current and a voltage) performed by the power-supply device 6. In addition, the control unit 7, which will be described later, causes the power-supply device 6 to finely adjust the values of necessary biases by utilizing measurement results (information regarding temperature and humidity) obtained by a measuring device 15 that is disposed in the housing 10 of the image forming apparatus 1 and that measures the temperature and the humidity inside the housing 10. The biases to be finely adjusted are, for example, the first transfer bias TB and the second transfer bias NB. For example, the fine adjustment is performed in the following manner. Ranges of temperature and humidity are each divided into plural segments beforehand, and appropriate values of the biases are set beforehand for each of the segments. The values of the biases are changed as necessary in accordance with the segments in which the temperature and the humidity, which have been measured, are included.

The image forming apparatus 1 includes the control unit 7 that controls each operation performed in the image forming apparatus 1.

The control unit 7 includes a processing unit, a memory device, an input/output device, an external memory device and is connected to various detectors, which detect states necessary for operations, such as image formation, and an input device via the input/output device so that detected information, input information, and the like are input to the control unit 7. In addition, the control unit 7 is connected to a device that is to be controlled by the control unit 7 (a controller of the device) so as to transmit necessary control information to the device. When information or the like that acts as a trigger for start of a control operation is input to the control unit 7, the control unit 7 transmits necessary control information and the like on the basis of various control programs and data items, which are stored in the memory device and the like, so as to control the operations of various devices. For example, the control unit 7 may sometimes control supplying and adjusting operations for the biases performed by the power-supply device 6, which have been described above, and perform control for a special operation, such as a toner discharging operation, which will be described later.

<Basic Image Forming Operation>

According to the image forming apparatus 1, a basic image forming operation is performed in the following manner. Here, the case of forming a polychromatic image formed by combining toner images of four colors (Y, M, C, and K), or specifically a full-color image will be described as an example.

Upon receiving an instruction for performing an image forming operation (printing operation), the four image forming devices 2 each perform formation of a toner image in a substantially similar manner.

That is to say, in each of the image forming devices 2 (Y, M, C, and K), the photoconductor drum 21 rotates in the direction of arrow A, and the charging device 22 charges the image-holding surface of the photoconductor drum 21 so as to have a predetermined polarity (e.g., negative polarity in the present exemplary embodiment) and a predetermined potential as a result of electric discharge that occurs on the basis of the charge bias CB, which is supplied to the charging roller of the charging device 22. After this charging process, the exposure devices 23 perform light exposure (light radiation) based on image signals, which have been decomposed to the four color components (Y, M, C, and K) and transmitted to the exposure devices 23, on the charged image-holding surfaces of the corresponding photoconductor drums 21. As a result, electrostatic latent images having the different color components and predetermined electrical potential differences are formed on the image-holding surfaces of the photoconductor drums 21.

Next, in the image forming devices 2 (Y, M, C, and K), the developing devices 24 (Y, M, C, and K) develop the corresponding electrostatic latent images, which have been formed on the image-holding surfaces of the photoconductor drums 21 and which have the different color components, by supplying the color toners (Y, M, C, and K), which are contained in the corresponding two-component developers 8 and which have been charged so as to have a predetermined polarity (negative polarity) by using the corresponding developing roller 24*b*, each of the color toners being in a state of being a magnetic brush, which is made of the magnetic carrier and the toner and which is napped, and by electrostatically depositing the color toners on the corresponding electrostatic latent images by using development fields formed on the basis of the developing bias DB, which is supplied between the developing rollers 24*b* and the photoconductor drums 21. Accordingly, the electrostatic latent images, which have the different color components and which have been formed on the photoconductor drums 21, are developed into visible toner images TI (FIG. 2) of the four colors (Y, M, C, and K) corresponding to the color components of the electrostatic latent images.

Then, the different color toner images TI, which have been formed on the photoconductor drums 21 of the image forming devices 2 (Y, M, C, and K), are transferred onto one of the recording sheets 9 via the intermediate transfer device 3.

In other words, the toner images TI of the different colors, which have been formed on the photoconductor drums 21, are transported to the first transfer positions, at each of which one of the photoconductor drums 21 and the corresponding first transfer device 25 are in contact with each other with the intermediate transfer belt 31, which rotates, interposed therebetween, after which the toner images TI are electrostatically transferred in a first transfer process onto the intermediate transfer belt 31 at the first transfer positions due to the influence of a first transfer electric field that is formed between each of the first transfer devices 25 and the corresponding photoconductor drum 21 (with the intermediate transfer belt 31 interposed therebetween) on the basis of the first transfer bias TB, which is supplied to transfer rollers of the first transfer devices 25.

Subsequently, the toner images TI, which have been transferred in the first transfer process onto the intermediate transfer belt 31, are transported to the second transfer position as a result of rotation of the intermediate transfer belt 31, after which the toner images TI are collectively and electrostatically transferred, at the second transfer position, in a second transfer process onto one of the recording sheets 9, which is sent out from the sheet feed device 4 and then transported to the second transfer position via the sheet transport path at a predetermined timing, due to the influence of a second transfer electric field that is formed on the basis of the second transfer bias NB, which is supplied to the second transfer roller 35.

Finally, the toner images TI, which have been transferred to the recording sheet 9, are fixed onto the recording sheet 9 by the fixing device 5.

In other words, after the recording sheet 9, to which the toner images TI have been transferred by the intermediate transfer device 3 in the second transfer process, has been separated from the intermediate transfer belt 31, the recording sheet 9 is transported to the fixing device 5. In the fixing device 5, the recording sheet 9, to which the toner images TI have been transferred, is introduced into the fixing-treatment part between the rotating body for heating 51 and the rotating body for applying pressure 52 so as to be heated and pressurized. This causes the toners, which form the toner images TI, to melt in such a manner as to be fixed onto the recording sheet 9. In the case where image formation is performed on only one surface of the recording sheet 9, after the toner images TI have been fixed to the recording sheet 9, the recording sheet 9 is transported to the ejection port 13 of the housing 10 via the sheet transport path and then ejected to the ejection-and-accommodation unit 12 so as to be accommodated in the ejection-and-accommodation unit 12.

Through the above image forming operation, a full-color image, which is formed by combining the four color toner images, is formed on one surface of one of the recording sheets 9.

<Toner Discharging Operation>

The image forming apparatus 1 is configured to perform an operation (toner discharging operation) of forming toner bands Tx, which are toner images that are to be discharged and that will not be transferred onto one of the recording sheets 9, on the surfaces of the photoconductor drums 21 in the image forming devices 2 (Y, M, C, and K).

For example, when an operation of forming an image having a relatively low image density is repeatedly performed, the toners of the two-component developers 8 may sometimes deteriorate as a result of a repeatedly occurring phenomenon in which, in the developing device 24, the toners are not used in a developing operation and are caused to return to the corresponding housings 24*a* from the corresponding developing rollers 24*b*. Thus, the toner discharging operation is performed in order to discharge part of the toners including such deteriorated toners from the developing devices 24 and reduce the amount of the deteriorated toners present in the housings 24*a* of the developing devices 24. Here, deterioration of the toners includes, for example, a phenomenon in which a property of being electrostatically transferred deteriorates due to deterioration of charging characteristics and a phenomenon in which an adhesive force of the toner increases as a result of an additive, which is deposited on the surfaces of particles of the toners, being buried in the particles so that the physical property of the toners being able to be transferred deteriorates. The toner discharging operation is performed as, for example, one of control operations performed by the control unit 7.

Figure 4:
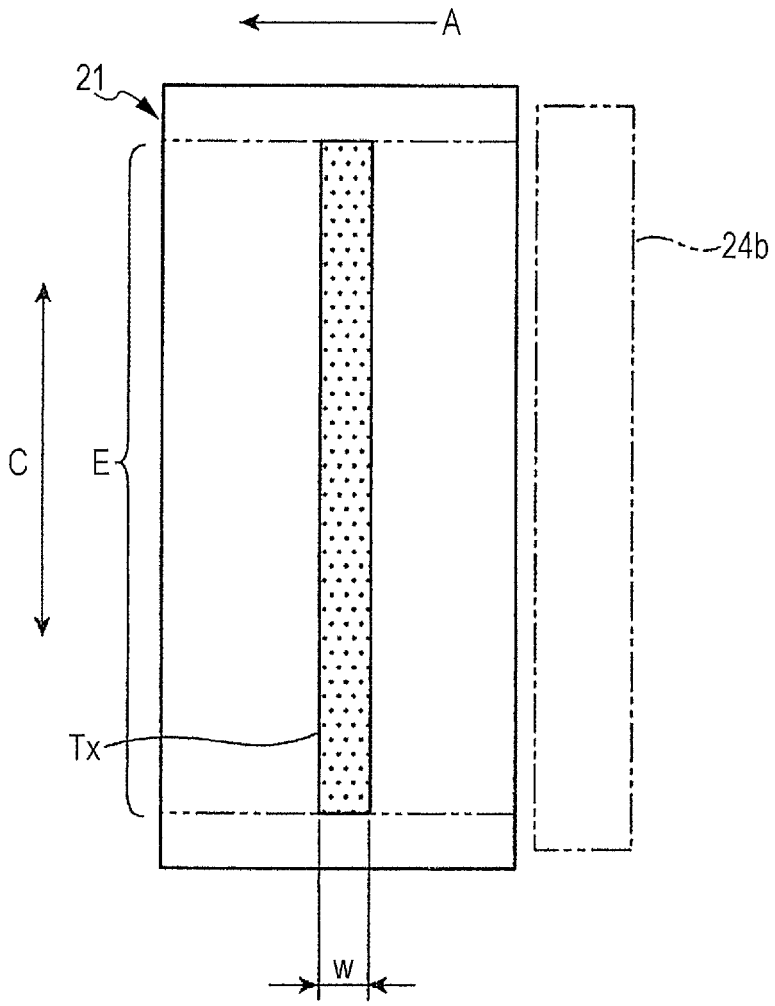
FIG. 4 is a diagram conceptually illustrating the configuration of a toner band formed by performing a toner discharging operation.

As illustrated in FIG. 4 as an example, in the entire region (image formable region E) of the image-holding surface of one of the photoconductor drums 21, one of the toner bands Tx is a toner image that has a belt-like shape (elongated rectangular shape) extending in the axial direction of the photoconductor drum 21 (direction of arrow C) while having a certain width w. The width w of the toner band Tx corresponds to the length of the toner band Tx in a rotation (circumferential) direction A of the photoconductor drum 21. In addition, the toner band Tx is formed in such a manner as to have a predetermined fixed density (such as image area percentage). In principle, the toner band Tx is formed in a portion between a region (image-formation-allocated region) in which an image for one surface of one of the recording sheets 9 is to be formed when an image formation is performed and another image-formation-allocated region for the next recording sheet 9 in the rotation direction A of the photoconductor drum 21 or is formed in a region of the photoconductor drum 21 during the period from when the last image forming operation has been completed until the operations of the image forming devices 2, the intermediate transfer device 3, and the like are stopped. The image information of the toner band Tx is stored in a memory or the like of the image processing apparatus (not illustrated). The timing at which the toner discharging operation is performed is, for example, the timing at which the number of recording sheets 9 on which images have been formed (number of sheets on which images have been printed) reaches a specified number of sheets (e.g., 40 sheets), which is set beforehand. Note that, although fixed values (of width and density) are usually applied to the width w and the density of each of the toner bands Tx, a value changed in accordance with predetermined conditions or conditions that are measured may be applied to at least one of the width w and the density.

The toner discharging operation that is normally performed has substantially the same contents as those of a normal image forming operation except for the following: the first transfer bias TB will not be supplied to the first transfer devices 25, the polarity of the second transfer bias NB that is supplied to the second transfer roller 35 is set to be opposite to that in the normal image forming operation (operation of forming not a toner image that is to be discharged but a normal toner image), and the recording sheets 9 will not be fed.

In practice, in the toner discharging operation, the image-holding surfaces of the photoconductor drums 21 are charged by the corresponding charging devices 22 first. Then, the exposure devices 23 perform light exposure according to the image information of the corresponding toner bands Tx on the corresponding charged image-holding surfaces in such a manner as to form electrostatic latent images for the toner bands Tx. After that, the developing devices 24 develop the corresponding electrostatic latent images, so that the toner bands Tx are formed on the photoconductor drums 21.

Next, each of the toner bands Tx is transported as a result of rotation of the corresponding photoconductor drum 21, and most of the toner band Tx is sent to the corresponding drum-cleaning device 26 by passing through the corresponding first transfer position and removed and collected by the drum-cleaning device 26. Even if part of the toner that forms the toner band Tx has been transferred to the intermediate transfer belt 31 at the first transfer position, the part of the toner is sent to the belt-cleaning device 36 by passing through the second transfer position and removed and collected by the belt-cleaning device 36.

Thus, when the toner discharging operation is performed, toners are discharged from the developing devices 24 to the corresponding photoconductor drums 21 first, and the discharged toners are collected by the corresponding drum-cleaning devices 26 and the belt-cleaning device 36.

Note that, in principle, in the toner discharging operation, the toners that form the toner bands Tx are less likely to be transferred in a first transfer process onto the intermediate transfer belt 31 when the toners pass through the corresponding first transfer positions, at each of which one of the photoconductor drums 21 and the intermediate transfer belt 31 are in contact with each other. That is to say, when the toner discharging operation is performed, since the first transfer bias TB is not supplied to the first transfer devices 25 as described above, the first transfer electric field, which is formed in a normal image forming operation, will not be formed at each of the first transfer positions. Consequently, each of the toners, which form the toner bands Tx, will not be electrostatically transferred onto the intermediate transfer belt 31 by being influenced by the first transfer electric field. Note that, in practice, part of the toners, which form the toner bands Tx, is transferred onto the intermediate transfer belt 31 due to a physical adhesive force and the like of the toners even in the case where the first transfer bias TB is not supplied to the first transfer devices 25 (see, for example, residual percentage of toner of No. 8 shown in FIG. 8).

In addition, in the toner discharging operation, even in the case where part of the toners, which form the toner bands Tx, has been transferred to the intermediate transfer belt 31, the transferred toners are less likely to be transferred onto the second transfer roller 35. In other words, when the toner discharging operation is performed, since a bias having a polarity opposite to that in a normal image forming operation is supplied to the second transfer roller 35 as the second transfer bias NB, a second transfer electric field that acts in a direction opposite to the direction in which a normal second transfer electric field acts is formed at the second transfer position. Thus, when the toners, which have been transferred to the intermediate transfer belt 31, pass through the second transfer position, the toners are held by the intermediate transfer belt 31 in such a manner as to be electrostatically deposited on the intermediate transfer belt 31, so that the toners will not be electrostatically transferred onto the second transfer roller 35. However, also in this case, part of the transferred toners may sometimes be transferred onto the second transfer roller 35 due to the above-mentioned physical adhesive force and the like.

In particular, when the toner discharging operation is performed, most of the toners, which form the toner bands Tx and which have been transported to the corresponding drum-cleaning devices 26, are scraped off and removed by the corresponding plate-shaped members 26*b*. However, part of each of the toners stays between a contact end of the corresponding plate-shaped member 26*b* and the corresponding photoconductor drum 21.

The toners (toner particles, an additive, and the like), each of which stays between the corresponding contact end and the corresponding photoconductor drum 21, each act like a lubricating material between the corresponding plate-shaped member 26*b* and the image-holding surface of the photoconductor drum 21. This reduces friction generated between each of the plate-shaped members 26*b* and the image-holding surface of the corresponding photoconductor drum 21, and accordingly, noise due to an end portion of each of the plate-shaped members 26*b* that slides along the corresponding photoconductor drum 21 is less likely to occur, and peeling and wear of the contact end of each of the plate-shaped members 26*b* are less likely to occur. In addition, the toners, each of which stays between the corresponding contact end and the corresponding photoconductor drum 21, act so as to remove corona products deposited on the image-holding surfaces of the corresponding photoconductor drums 21.

The inventors of the present invention conduct studies and find that, when a toner discharging operation (of the related art) such as that described above is performed, the following phenomena that should be considered as problems occur.

That is to say, when the toner bands Tx are formed on the photoconductor drums 21 by performing the toner discharging operation, part of the carrier may also sometimes be discharged from the developing devices 24 and may sometimes be present in the toner bands Tx, and the carrier, which is present in the toner bands Tx, will gradually accumulate as a result of being transferred onto the intermediate transfer belt 31 and then transferred onto the second transfer roller 35. As a result, a phenomenon in which the carrier, which has accumulated on the second transfer roller 35, is deposited on the rear surface (surface that is brought into contact with the second transfer roller 35) of one of the recording sheets 9, which passes through the second transfer position when a normal image forming operation is performed, may sometimes occur.

This deposition of the carrier on the rear surface of the recording sheet 9 induces, in the case of, for example, forming an image on the rear surface of the recording sheet (in the case of forming an image on the two surfaces of the recording sheet 9), an image quality defect, such as a missing image, at a position corresponding to a portion of the rear surface of the recording sheet 9 in which the carrier is present.

The inventors of the present invention surmise that the above-described phenomena (particularly the phenomenon in which the carrier, which is present in one of the toner bands Tx, is transferred onto the second transfer roller 35 and accumulates) occur by the following mechanism.

That is to say, when a toner image is formed, part of the toner, which has been contained in one of the developing devices 24 and which has been charged so as to have a negative polarity, is used for a developing operation and transferred onto the corresponding photoconductor drum 21, and it is assumed that the polarity of part of the carrier, which has been contained in the developing device 24 and which usually has been charged so as to have a positive polarity due to frictional electrification, is inverted as a result of an electric charge being injected into the part of the carrier by supplying the developing bias DB, so that the part of the carrier may sometimes be electrostatically transferred onto the photoconductor drum 21. It may be said that this phenomenon may also occur when toner images of the toner bands Tx, which are to be discharged, are formed.

Regarding the behavior and state of the carrier, it is assumed that, in a normal image forming operation, the polarity and transfer destination of the carrier, which has been transferred to the photoconductor drum 21 at a developing position, transition in the manner shown in the upper table of FIG. 5 when the carrier passes through the corresponding first transfer position and the second transfer position.

More specifically, part of the carrier in the developing device 24 is caused to have a negative polarity as a result of an electric charge being injected into the part of the carrier due to the negative (−) polarity of the developing bias DB and is electrostatically transferred onto the corresponding photoconductor drum 21, after which the part of the carrier is caused to have a positive polarity again at the first transfer position as a result of an electric charge being injected into the part of the carrier due to the positive (+) polarity of the first transfer bias TB, which is supplied to the corresponding first transfer roller. Accordingly, when the carrier is transferred onto the photoconductor drum 21 and passes through the first transfer position, the carrier is in a state of being electrostatically deposited on the photoconductor drum 21, which has been charged so as to have a negative polarity, and will not be electrostatically transferred onto the intermediate transfer belt 31.

Note that, in this case, if the part of the carrier caused to have a positive polarity as a result of an electric charge being injected into the part of the carrier at the first transfer position is transferred onto the intermediate transfer belt 31, there is a case where the transferred carrier is caused to have a negative polarity as a result of an electric charge being injected into the carrier due to the negative polarity of the second transfer bias NB supplied to the support roller (second-transfer-backup roller) 32*b* at the second transfer position, so that the carrier is influenced by an electrostatic repulsive force, and as a result, the carrier is transferred from the intermediate transfer belt 31 onto one of the recording sheets 9, which is fed to the second transfer position.

However, such transition and deposition of the carrier onto one of the recording sheets 9 will very rarely occur in a normal image forming operation, and the amount of the carrier to be transferred onto the recording sheet 9 from one of the image forming devices 2 is a trace amount. The trace amount is, for example, an amount of the carrier that allows not more than 10 particles of the carrier to be transferred onto one surface of a single A3 sheet. Accordingly, the upper table of FIG. 5 shows "(RECORDING SHEET)" as the transfer destination of the carrier at the second transfer position, and the parentheses indicate that the recording sheet 9 will very rarely become the transfer destination.

Next, in a toner discharging operation of the related art, it is assumed that the polarity and transfer destination of the carrier, which has been transferred to the corresponding photoconductor drum 21 at the developing position, transition in the manner shown in the lower table of FIG. 5 when the carrier passes through the corresponding first transfer position and the second transfer position.

More specifically, part of the carrier in the developing device 24 is caused to have a negative polarity as a result of an electric charge being injected into the part of the carrier due to the negative (−) polarity of the developing bias DB and is electrostatically transferred onto the corresponding photoconductor drum 21, and an electric charge is not injected into the carrier because the first transfer bias TB is not supplied at the first transfer position (potential is about 0 V), so that the transferred carrier maintains its negative polarity. Consequently, when the carrier is transferred onto the photoconductor drum 21 and passes through the first transfer position, the carrier receives an electrostatic repulsive force from the photoconductor drum 21, which has been charged so as to have a negative polarity (particularly a toner layer of the toner band Tx, which has been formed on the photoconductor drum 21 and which has a negative surface potential), and thus, the carrier is transferred from the photoconductor drum 21 onto the intermediate transfer belt 31.

Then, the carrier, which has been transferred to the intermediate transfer belt 31, the carrier is caused to have a positive polarity as a result of an electric charge being injected into the carrier due to the positive polarity of the second transfer bias NB (having a polarity opposite to the polarity of the second transfer bias NB in a normal image forming operation) supplied to the support roller 32*b* at the second transfer position, so that the carrier is influenced by the electrostatic repulsive force, and as a result, the carrier is transferred from the intermediate transfer belt 31 onto the second transfer roller 35.

Therefore, it is assumed that, when the toner discharging operation of the related art is performed, the carrier is transferred onto the second transfer roller 35 and accumulates on the second transfer roller 35.

<Improvement of Toner Discharging Operation>

Accordingly, in the image forming apparatus 1, when the toner discharging operation is performed, the control unit 7 is configured to perform control in such a manner that a direct current or a DC voltage having a value equal to or larger than the value of a current or a voltage that enables an electric charge to be injected into the carrier, which is present in the toner bands Tx serving as toner images that are to be discharged, is supplied as the first transfer bias TB, which is supplied from the power-supply device 6.

In other words, although when the toner discharging operation of the related art is performed, one of control conditions is that the first transfer bias TB is not supplied (potential is set to be about 0 V), when the image forming apparatus 1 performs the toner discharging operation, the one of control conditions is changed in such a manner that a direct current or a DC voltage having at least a value equal to or larger than the above-mentioned value of a current or a voltage is supplied as the first transfer bias TB.

Here, the above-mentioned carrier, which is present in the toner bands Tx, is the carrier contained in the toner bands Tx formed on the photoconductor drums 21. In addition, the value of a current or a voltage that enables an electric charge to be injected into the above-mentioned carrier is the value of a current or a voltage that causes the polarity of the electric charge of the carrier, which is present in the toner bands Tx, to be inverted as a result of being influenced by the first transfer bias TB.

The value of the current or the voltage that enables an electric charge to be injected into the carrier may be measured by performing the following process. One of the toner bands Tx having a fixed width and density is formed in an environment with, for example, a temperature of 22° C. and a relative humidity of 55% and caused to pass through the corresponding first transfer position each time the value of the direct current or the DC voltage of the first transfer bias TB is changed, and a toner layer (group) that has been transferred to a portion of the intermediate transfer belt 31 immediately after each time the toner band Tx has passed through the first transfer position is collected by using an adhesive tape or the like. When it becomes difficult to confirm that the carrier is present in the toner layer, the value of the current or the voltage is determined. The term "to confirm that the carrier is present in the toner layer" mentioned above refers to, for example, confirming a state where 20 or more particles of the carrier are present on one surface of a single A4 sheet. In this case, a magnetic carrier that is formed by coating a surface of a ferrite core with a resin and that has an electric resistance of $1\times10^{8}$ Ωcm or larger and $1\times10^{14}$ Ωcm or smaller and an average particle diameter of 20 μm or larger and 100 μm or smaller is used as the carrier.

Note that, in the case where the measurement is performed by using a printer (DocuCentre-IV C2260) manufactured by Fuji Xerox Co., Ltd., the above-mentioned value of a current that enables an electric charge to be injected into the carrier is about 2.7 μA.

The value of a current or a voltage that enables an electric charge to be injected into the carrier, which is present beforehand in the toner band Tx, is measured and determined by the above-described measuring method, and the value of a current or a voltage that is set on the basis of the measured value is used as a current or a voltage having a value equal to or larger than the above-mentioned value of a current or a voltage. A maximum value of the current or the voltage having a value equal to or larger than the above-mentioned value of a current or a voltage is set to be the value of the current or the voltage of the first transfer bias TB that is supplied when a normal image forming operation is performed. For example, the value of the current or the voltage of the first transfer bias TB used in a normal image forming operation that is performed immediately before each time the toner discharging operation is performed may be used as the value of the current or the voltage of the first transfer bias TB that is supplied when a normal image forming operation is performed.

The first transfer bias TB that is supplied, when the toner discharging operation is performed, from each of the power-supplying units 61 (Y, M, C, and K), which are included in the power-supply device 6 and which correspond to the four image forming devices 2 (Y, M, C, and K), may be set to be a different value of a current or a voltage depending on the power-supplying units 61 (Y, M, C, and K) or may be set to be the same value of a current or a voltage.

In the toner discharging operation that is performed in the image forming apparatus 1, it is assumed that the probability that the carrier, which is present in one of the toner bands Tx, will be transferred onto the intermediate transfer belt 31 and further transferred onto the second transfer roller 35 may be reduced by the following mechanism.

That is to say, as shown in FIG. 6, the carrier that is present in the toner band Tx as a result of being made to have a negative polarity as a result of an electric charge being injected into the carrier due to the negative polarity of the developing bias DB and being electrostatically transferred onto the corresponding photoconductor drum 21 is caused to have a positive polarity again as a result of an electric charge being injected into the carrier due to the positive polarity of the first transfer bias TB because the first transfer bias TB, which is a direct current or a DC voltage having a positive polarity and a value equal to or larger than the value of a current or a voltage that enables an electric charge to be injected into the carrier, is supplied to the corresponding first transfer roller at the corresponding first transfer position. Accordingly, the carrier that is transferred onto the photoconductor drum 21 and passes through the first transfer position is in a state of being electrostatically deposited on the photoconductor drum 21, which has been charged so as to have a negative polarity, and will not be electrostatically transferred onto the intermediate transfer belt 31.

Note that, in this case, if part of the carrier caused to have a positive polarity as a result of an electric charge being injected into the carrier at the first transfer position is transferred onto the intermediate transfer belt 31, there is a case where the transferred carrier is caused to have a positive polarity as a result of an electric charge being injected into the carrier due to the positive polarity of the second transfer bias NB supplied to the support roller 32*b*, so that the carrier is influenced by an electrostatic repulsive force and transferred from the intermediate transfer belt 31 onto the second transfer roller 35.

However, in the toner discharging operation that is performed in the image forming apparatus 1, the carrier will rarely be transferred onto the intermediate transfer belt 31, and thus, the carrier will rarely be transferred onto and deposited on the second transfer roller 35. The table of FIG. 6 shows "(SECOND TRANSFER ROLLER)" as the transfer destination of the carrier at the second transfer position, and the parentheses also indicate that the second transfer roller 35 will very rarely become the transfer destination.

In particular, from the standpoint of reducing, with certainty on the basis of results of tests, which will be described later, the probability that the carrier, which is present in the toner band Tx, will be transferred onto the intermediate transfer belt 31, it is desirable to control in such a manner that a direct current whose value is 30% or about 30% or higher of the value of the current of the first transfer bias TB that is supplied when a normal image forming operation is performed (when a toner image is transferred in a first transfer process onto an intermediate transfer body) is supplied as the direct current having a value equal to or larger than the above-mentioned value of a current.

In addition, in the image forming apparatus 1, from the standpoint of enabling, on the basis of the results of the tests, which will be described later, the toner of the toner band Tx to be supplied to the corresponding drum-cleaning device 26 with certainty, it is desirable to control in such a manner that a direct current whose value is 70% or about 70% or lower of the value of the current of the first transfer bias TB that is supplied when a normal image forming operation is performed is supplied as the first transfer bias TB that is supplied from the power-supply device 6 when the toner discharging operation is performed.

<Test 1>

First, the inventors of the present invention conduct Test 1 for checking a deposition state and the like of the carrier on the intermediate transfer belt 31 when a toner discharging operation of the related art is performed. In Test 1, the toner bands Tx that satisfy the conditions (widths and densities) shown in FIG. 7 are each formed on one of the photoconductor drums 21 by using the image forming apparatus 1 (only the image forming device 2K of the image forming apparatus 1), and the toner discharging operation is forcibly suspended at the timing at which each of the toner bands Tx would reach a position between the second transfer position and the belt-cleaning device 36 when it is assumed that the toner band Tx is transferred in a first transfer process onto the intermediate transfer belt 31 and passes through the second transfer position. Next, when it is assumed that the toner band Tx has been transferred in the first transfer process to the intermediate transfer belt 31, an adhesive tape having a certain width is pressed against an area of the intermediate transfer belt 31 to which the toner band Tx would be transferred so that the toner band Tx is transferred onto and collected by the adhesive tape. In this manner, the deposition state and the deposition amount of the carrier on the intermediate transfer belt 31 for each of the toner bands Tx is determined.

In addition, in Test 1, after the deposition state and the like of the carrier have been determined, a normal image forming operation is performed by using the intermediate transfer belt 31 as is, and it is determined whether the carrier is deposited on the rear surface of one of the recording sheets 9 that has passed through the second transfer position in the normal image forming operation.

In Test 1, a two-component developer that contains a toner whose particles each have an average particle diameter of 5.2 μm and are each formed by depositing an additive on a mother particle composed mainly of styrene acrylic by the emulsion polymerization method and a carrier whose particles each have an average particle diameter of 35 μm and an electrical resistance of $4\times10^{10}$ Ωcm (carrier resistance in an electric field of $10^{3.8}$ V/cm) and are each formed of Mn—Mg-based ferrite particles (each having a true specific gravity of 4.6 g/cm$^3$, a volume average particle diameter of 35 μm, and a saturation magnetization of 65 emu/g) coated with a resin material, which is made of dimethylaminoethyl methacrylate-styrene-methyl methacrylate copolymer and carbon black, is used as the two-component developer 8.

In the toner discharging operation, a voltage obtained by superposing an AC voltage on a DC voltage of −300 V is supplied as the developing bias DB from the power-supply device 6 to the corresponding developing roller 24*b*, and a DC voltage of +2 kV is supplied as the second transfer bias NB from the power-supply device 6. On the other hand, the first transfer bias TB is not supplied in such a manner that the electrical potential difference at the corresponding first transfer position is about 0 V. Switching of the polarity of the second transfer bias NB is performed at the timing at which the toner band Tx is assumed to pass through the second transfer position after being transferred in the first transfer process onto the intermediate transfer belt 31. The density of the toner band Tx is an image area percentage. A member (whose outer diameter is about 20 mm) that is formed by forming an elastic body layer, which is made of urethane containing carbon, on a metal core is used as the second transfer roller 35.

The results of Test 1 are evaluated in accordance with the following criteria. The results of the evaluation are shown in FIG. 7.

A: No carrier is deposited on the intermediate transfer belt 31.

B: Although a small amount of carrier is deposited on the intermediate transfer belt 31, no carrier is deposited on the rear surface of the recording sheet 9 in a normal image forming operation performed after the toner discharging operation. This is within an allowable limit for use.

C: The carrier is deposited on the intermediate transfer belt 31, and also the carrier is deposited on the rear surface of the recording sheet 9 in a normal image forming operation performed after the toner discharging operation.

D: A large amount of carrier is deposited on the intermediate transfer belt 31, and also the carrier is deposited on the rear surface of the recording sheet 9 in a normal image forming operation performed after the toner discharging operation.

As seen from the results shown in FIG. 7, the deposition amount of the carrier on the intermediate transfer belt 31 is likely to increase as the width w of the toner band Tx increases.

However, it is confirmed that, in the case where the width w of the toner band Tx is 50 mm or smaller, the probability that the carrier will be transferred onto the second transfer roller 35 may be reduced with certainty. It is assumed that this is because the amount of the toner, which is discharged, decreases as the width w of the toner band Tx decreases, so that a reduction amount of the toner density (TC) in the corresponding developing device 24 decreases, and thus, injection of an electric charge into the carrier due to a development field is less likely to occur, so that the amount of the carrier to which an electric charge has been injected and which is transferred onto the photoconductor drum 21 also decreases.

Also in the case where the width w of the toner band Tx is set to be large (e.g., 200 mm), it is understood that the deposition amount of the carrier on the intermediate transfer belt 31 may be reduced by reducing the density of the toner band Tx. In the case where no toner band Tx is formed (in the case where the width w is 0), deposition of the carrier is not observed.

Note that, in the actual toner discharging operation, the four image forming devices 2 (Y, M, C, and K) form the toner bands Tx of the corresponding colors, and the carrier, which is dispersed and present in the toner bands Tx of the different colors, will eventually be transferred onto the second transfer roller 35 so as to be collected, and thus, the carrier accumulates on the second transfer roller 35 as if the carrier is concentrated (integrated).

<Test 2>

Next, on the basis of the knowledge obtained from Test 1, the inventors of the present invention conduct Test 2 for checking a deposition state and the like of the carrier on the intermediate transfer belt 31 in the case where the conditions for the first transfer bias TB when the toner discharging operation is performed are changed.

In Test 2, the toner bands Tx that satisfy the conditions (widths) shown in FIG. 8 are each formed on one of the photoconductor drums 21 by using the image forming apparatus 1 (only the image forming device 2K of the image forming apparatus 1), which is obtained by modifying the printer (DocuCentre-IV C2260) manufactured by Fuji Xerox Co., Ltd. and by performing a constant current control on the power-supply device 6 so as to cause the power-supply device 6 to supply the first transfer bias TB (direct current) under each of the conditions shown in FIG. 8, and the deposition state and the deposition amount of the carrier on the intermediate transfer belt 31 for each of the toner bands Tx is determined in a similar manner to Test 1.

In Test 2, when each of the toner bands Tx is formed by supplying the first transfer bias TB under a corresponding one of the above-mentioned conditions and the like, a residual state and a residual percentage of the toner that remains on the photoconductor drum 21 after the toner band Tx has passed through the corresponding first transfer position is determined.

Test 2 is conducted under the same conditions as those in Test 1 except for the following.

Each of the toner bands Tx is formed in such a manner that the width w and the density thereof are respectively 200 mm and an image area percentage of 100%. The control percentage of the first transfer bias TB is a percentage of a reference value when the value of the direct current of the first transfer bias TB in a normal image forming operation is 100% of the reference value. As the value of the direct current of the first transfer bias TB, which is the reference value, a value of a current having a positive polarity that enables toner images of the toner bands Tx, which satisfy the above-mentioned conditions, to be transferred in a first transfer process onto the intermediate transfer belt 31 with a transfer efficiency of 99% or higher (efficiency in an environment with a temperature of 22° C. and a relative humidity of 55%) is employed.

Regarding the toner that remains on the photoconductor drum 21, after forcibly suspending the image forming apparatus 1 at the timing immediately after each time one of the toner bands Tx has passed through the first transfer position, the toner in a region of the photoconductor drum 21 on which each of the toner bands Tx is formed is sucked in and collected, and the mass of the collected toner is measured. The residual percentage of the toner is calculated by calculating the percentage [(m/M)×100] of the mass (m) of the toner, which has been measured, with respect to the mass (M) of the toner that is present on the photoconductor drum 21 when each of the toner bands Tx, which satisfy the above-mentioned conditions, is formed on the photoconductor drum 21 (before passing through the first transfer position).

The results of the deposition state of the carrier in Test 2 are evaluated in accordance with the same criteria as the criteria in Test 1, and the results of the residual state of the toner are evaluated in accordance with the following criteria. The results of these evaluations are shown in FIG. 8.

A: A relatively large amount (residual percentage of 20% or higher) of toner remains on the photoconductor drum 21.

B: A small amount of toner remains on the photoconductor drum 21, and the toner is supplied to the plate-shaped member 26*b* of the drum-cleaning device 26 in such a manner that the toner stays between the contact end of the plate-shaped member 26*b* and the photoconductor drum 21. This is within an allowable limit for use.

C: Although a small amount of toner remains on the photoconductor drum 21, and even when the toner is supplied to the plate-shaped member 26*b* of the drum-cleaning device 26, the toner does not stay between the contact end of the plate-shaped member 26*b* and the photoconductor drum 21.

It is understood from the results shown in FIG. 8 that, in the case where a direct current whose control percentage is 30% or about 30% or higher is supplied as the first transfer bias TB when the toner discharging operation is performed (No. 1 to No. 6), the probability that the carrier will be transferred onto the intermediate transfer belt 31 may be reduced. It is also understood that, in the case where a direct current whose control percentage is 40% or higher is supplied as the first transfer bias TB (No. 1 to No. 5), the probability that the carrier will be transferred onto the intermediate transfer belt 31 may be reduced with more certainty.

Therefore, it is confirmed that, even in the case where the toner discharging operation is performed, the probability that the carrier will be transferred onto the intermediate transfer belt 31 may be reduced by supplying, as the first transfer bias TB, a direct current having at least a value that enables an electric charge to be injected into the carrier, which is present in the toner bands Tx, when the toner discharging operation is performed.

In addition, it is understood from the results shown in FIG. 8 that, in the case where a direct current whose control percentage is higher than 80% is supplied as the first transfer bias TB when the toner discharging operation is performed (No. 1 and No. 2), the toner, which forms each of the toner bands Tx, will not remain on the photoconductor drum 21 after passing through the first transfer position and is less likely to be supplied to the plate-shaped member 26*b* of the drum-cleaning device 26.

In this case, for example, there is a possibility that wear of the contact end of the plate-shaped member 26*b* in the drum-cleaning device 26 will be likely to occur, and there is a possibility that the plate-shaped member 26*b* will not be able to efficiently remove corona products deposited on the image-holding surface of the photoconductor drum 21, which in turn induces deterioration of the performance of the photoconductor drum 21 due to accumulation of the corona products.

Therefore, it is understood that, in the case of considering to avoid these problems, it is desirable to supply a direct current having a value that is at least 70% or about 70% or lower of the value of a current supplied when a normal image forming operation is performed as the first transfer bias TB when the toner discharging operation is performed (the cases of No. 3 to No. 8).

Generalizing the results of Test 2, it is understood that, in the case where a direct current having a value that is within a range of 30% or about 30% or higher and 70% or about 70% or lower of the value of a current supplied when a normal image forming operation is performed is supplied as the first transfer bias TB when the toner discharging operation is performed (the cases of No. 3 to No. 6), even when the toner discharging operation is performed, the probability that the carrier will be transferred onto the intermediate transfer belt 31 (eventually onto the second transfer roller 35) may be reduced while ensuring that the toner is supplied to the drum-cleaning device 26 of the photoconductor drum 21 (the plate-shaped member 26*b* of the drum-cleaning device 26). In addition, it is understood that, in the case where a direct current having a value that is within a range of 40% or higher and 50% or lower of the value of the current supplied when a normal image forming operation is performed is supplied as the first transfer bias TB (the cases of No. 4 and No. 5), the above-mentioned probability may be reduced with more certainty while ensuring that the toner is supplied to the drum-cleaning device 26 (the plate-shaped member 26*b*) with more certainty.

Note that, according to researches of the inventors of the present invention, it is confirmed that, in the case where a toner band whose width w is within a range (70 mm or larger and 200 mm or smaller) smaller than 200 mm is formed as each of the toner bands Tx, and Test 2 is conducted in a similar manner to the above, the results regarding the deposition state of the carrier and the residual state (residual percentage) of the toner have substantially similar tendency to the above results (in particular, the deposition amount of the carrier is likely to decrease as the width w decreases).

In addition, in the above-described Tests 1 and 2, the case where a direct current is supplied by being controlled as the first transfer bias TB supplied when the toner discharging operation is performed has been described as an example, a DC voltage may be supplied as the first transfer bias TB by controlling the DC voltage so as to make the DC voltage to have the above-mentioned value that enables an electric charge to be injected into the carrier.

In the image forming apparatus 1, in order to transfer the toner deposited on the second transfer roller 35 onto the intermediate transfer belt 31 and remove the toner by using belt-cleaning device 36, an operation of switching the polarity of the second transfer bias NB and then supplying the second transfer bias NB to the support roller 32*b* (or second transfer roller 35) from the power-supply device 6 (power supplying unit 63) when an image forming operation is not performed, which is a so-called second-transfer-cleaning operation, may be added as one of control operations performed by the control unit 7. When the second-transfer-cleaning operation is performed, the toner deposited on the second transfer roller 35 is influenced (even if the toner has an opposite charge polarity) by an electric field, which is formed between the second transfer roller 35 and the intermediate transfer belt 31 and whose polarity is changed as a result of the second transfer bias NB being supplied, electrostatically transferred onto the intermediate transfer belt 31, and eventually collected by the belt-cleaning device 36.

According to researches of the inventors of the present invention, it is confirmed that, performing the above second-transfer-cleaning operation is much less effective in causing the carrier, which has been transferred to and deposited on the second transfer roller 35 as a result of performing the toner discharging operation several times, to be transferred onto the intermediate transfer belt 31 and eventually collected by the belt-cleaning device 36 compared with the case of the toner. It is assumed that this is because the polarity of the carrier deposited on the second transfer roller 35 is also changed as a result of an electric charge being injected into the carrier due to the second transfer bias NB that is supplied while the polarity thereof is switched when the second-transfer-cleaning operation is performed, and thus, the probability that the carrier will be electrostatically transferred onto the intermediate transfer belt 31 by being influenced by the electric field, which is formed between the second transfer roller 35 and the intermediate transfer belt 31 is low.

Other Exemplary Embodiments

Although the case where the first transfer bias TB, which is controlled to have a value of a current within a predetermined range, is supplied when the toner discharging operation is performed has been described in the exemplary embodiment as an example, other configurations including the following may be employed.

For example, in an environment in which injection of an electric charge into the carrier is less likely to occur, the first transfer bias TB that is supplied when the toner discharging operation is performed may be adjusted to be a direct current having a value that is a relatively small percentage (e.g., higher than 0% and 30% or lower) of the value of the current of the first transfer bias TB in a normal image forming operation. An example of the environment in which injection of an electric charge into the carrier is less likely to occur is a low-humidity environment.

In addition, although the case where the image forming apparatus 1 includes the four image forming devices 2 (Y, M, C, and K), has been described in the exemplary embodiment as an example, the image forming apparatus 1 may include any number (including one) of image forming devices 2. Furthermore, regarding a controller that controls the operation of the power-supply device 6, a dedicated control unit for the power-supplying device 6 may be used instead of the control unit 7.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an intermediate transfer body;

an image forming device that includes an image carrier on which an electrostatic latent image is to be formed, a developing device that develops the electrostatic latent image on the image carrier into a toner image with a two-component developer containing a toner and a carrier, a first transfer device that transfers in a first transfer process the toner image on the image carrier onto the intermediate transfer body, and a first cleaning device that comes into contact with a surface of the image carrier and cleans the surface of the image carrier after the toner image has been transferred to the intermediate transfer body;

a second transfer device that transfers in a second transfer process the toner image, which has been transferred from the image forming device to the intermediate transfer body, onto a recording medium;

a second cleaning device that comes into contact with a surface of the intermediate transfer body and cleans the surface of the intermediate transfer body after the toner image has been transferred to the recording medium;

a power-supplying device that supplies a developing bias, a first transfer bias, and a second transfer bias to the developing device, the first transfer device, and the second transfer device, respectively; and a controller that performs control in such a manner that a toner discharging operation, in which a toner image that is to be discharged and that is not to be transferred onto the recording medium is formed on the image carrier, is performed in the image forming device, wherein, when the toner discharging operation is performed, the controller performs control in such a manner that a direct current or a direct-current voltage having a value not smaller than a value of a current or a voltage that enables an electric charge to be injected into the carrier that is present in the toner image, which is to be discharged, is supplied as the first transfer bias from the power-supplying device, and wherein, when the toner discharging operation is performed, the controller performs control in such a manner that a direct current whose value is not higher than about 70% of a value of a current that is used when a normal toner image, which is not the toner image to be discharged, is transferred in the first transfer process onto the intermediate transfer body is supplied as the first transfer bias, which is supplied from the power-supplying device.

2. The image forming apparatus according to claim 1, wherein, when the toner discharging operation is performed, the controller performs control in such a manner that a direct current whose value is not lower than about 30% of a value of a current that is used when a normal toner image, which is not the toner image to be discharged, is transferred in the first transfer process onto the intermediate transfer body is supplied as the first transfer bias, which is supplied from the power-supplying device.

* * * * *